US007922895B2

(12) United States Patent
Banerjee

(10) Patent No.: US 7,922,895 B2
(45) Date of Patent: Apr. 12, 2011

(54) SUPERCRITICAL WATER PROCESSING OF EXTRA HEAVY CRUDE IN A SLURRY-PHASE UP-FLOW REACTOR SYSTEM

(75) Inventor: Dwijen K. Banerjee, Ponca City, OK (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 12/633,232

(22) Filed: Dec. 8, 2009

(65) Prior Publication Data

US 2010/0314583 A1 Dec. 16, 2010

Related U.S. Application Data

(63) Continuation-in-part of application No. 11/424,196, filed on Jun. 14, 2006, now abandoned.

(51) Int. Cl.
*C10G 31/00* (2006.01)

(52) U.S. Cl. ..... 208/112; 208/89; 208/177

(58) Field of Classification Search ..... 208/89, 208/112, 177, 264

See application file for complete search history.

(56) References Cited

U.S. PATENT DOCUMENTS 3,948,755 A * 4/1976 McCollum et al. ..... 208/391
3,960,706 A * 6/1976 McCollum et al. ..... 208/112
4,342,876 A 8/1982 Klingman
4,381,993 A 5/1983 Nevitt
4,446,012 A * 5/1984 Murthy et al. ..... 208/130
4,840,725 A 6/1989 Paspek
5,055,175 A 10/1991 Ng et al.
6,325,921 B1 12/2001 Andersen
6,887,369 B2 5/2005 Moulton et al.
2005/0040081 A1 2/2005 Takahashi et al.
2005/0072137 A1 4/2005 Hokari et al.

OTHER PUBLICATIONS

English abstract of JP Appl. No. 10284887, Patent Abstracts of Japan No. 2000109850, Apr. 18, 2000, Ota Kazuaki et al.
Section LVI Potassium Carbonate, W.H. Lee and M. F. C. Ladd, Refs. p. 1921, pp. 1888-1925.
Supplement to Mellor's Comprehensive Treatise on Inorganic and Theoretical Chemistry, vol. II, Supplement III, The Alkali Metals, Part 2.
The Journal of the American Chemical Society, A Study of the Oxides of Potassium and Sodium, Charles A. Kraus and Earle F. Whyte, vol. 48, Jul. 1926. No. 7.
Three Phase Slurry Reactors, R.V. Chaudhari and P.A. Ramachandran, Journal Review, Mar. 1980, pp. 177-201.
Topical Report, Slurry Reactor Design Studies, DOE Project No. DE-AC22-89PC89867, Reactor Selection Criteria, pp. 1-48.
Hydrogenation of Hydrocarbons through Partial Oxidation in Supercritical Water, Kunio Arai, Tadafumi Adschiri, and Masaru Watanabe, Ind. Eng. Chem. Res. 2000, 39, 4697-4701.
Gary, J.H., et al (1994). Petroleum Refining Technology and Economics, 3rd ed.

* cited by examiner

*Primary Examiner* — Walter D Griffin
*Assistant Examiner* — Brian McCaig

(57) ABSTRACT

A method of mixing a catalyst with a heavy oil to create a heavy oil/catalyst mixture. This is followed by combining the heavy oil/catalyst mixture with supercritical water to form light hydrocarbon products and heavy hydrocarbon products. By doing so the light hydrocarbon products can be separated into a gaseous top product, an upgraded liquid hydrocarbon product and a water phase.

9 Claims, 2 Drawing Sheets

SUPERCRITICAL WATER PROCESSING OF EXTRA HEAVY CRUDE IN A SLURRY-PHASE UP-FLOW REACTOR SYSTEM

CROSS-REFERENCE TO RELATED APPLICATIONS

This application is a continuation-in-part of U.S. patent application Ser. No. 11/424,196, filed Jun. 14, 2006 now abandoned), which is herein incorporated by reference.

STATEMENT REGARDING FEDERALLY SPONSORED RESEARCH OR DEVELOPMENT

Not Applicable.

FIELD OF THE INVENTION

The present method describes a method of upgrading hydrocarbons.

BACKGROUND OF THE INVENTION

Current technologies for converting heavy crudes, bitumens, etc., to lighter products include: (1) hydrocracking or (2) combinations of coking or thermal operations followed by some form of hydroprocessing. In the former, reformation of heavy crude oil into lighter hydrocarbon products is accomplished by contacting the crude oil with hydrogen and catalyst which decomposes and cracks the hydrocarbons into lighter hydrocarbons. Various designs have been utilized in the past for hydrotreatment of heavy petroleum oil. For example, in some systems, a liquid petroleum feedstock is cracked in a down-flow fixed-bed reactor. The hydrocarbon products are removed from the bottom of the reactor.

This type of system is vulnerable to coking and may require frequent catalyst replacement. Other problems include flooding of the catalyst bed and plugging of the catalyst bed with metals present in the heavy oil. In addition, current crude conversion technologies are capital intensive and require a sophisticated refinery infrastructure including hydrogen plants, fuel, and feed for the production of hydrogen or a source of hydrogen.

Hence, there remains a need to provide a reactor system that avoids the problems associated with fixed bed catalyst reactors. There is also a need to provide a process that provides a cheaper source of hydrogen and apparatus for simultaneous and combined thermal and catalytic treatment of extra heavy crude oil.

SUMMARY OF THE INVENTION

A method of mixing a catalyst with a heavy oil to create a heavy oil/catalyst mixture. This is followed by combining the heavy oil/catalyst mixture in a slurry phase upflow reactor with supercritical water to form light hydrocarbon products and heavy hydrocarbon products. By doing so the light hydrocarbon products can be separated into a gaseous top product, an upgraded liquid hydrocarbon product and a water phase.

BRIEF DESCRIPTION OF THE DRAWING

For a more detailed description of the preferred embodiment of the present invention, reference will now be made to the accompanying drawing, which is a schematic diagram of a system constructed in accordance with the invention.

DETAILED DESCRIPTION OF THE PREFERRED EMBODIMENT

Figure 1:
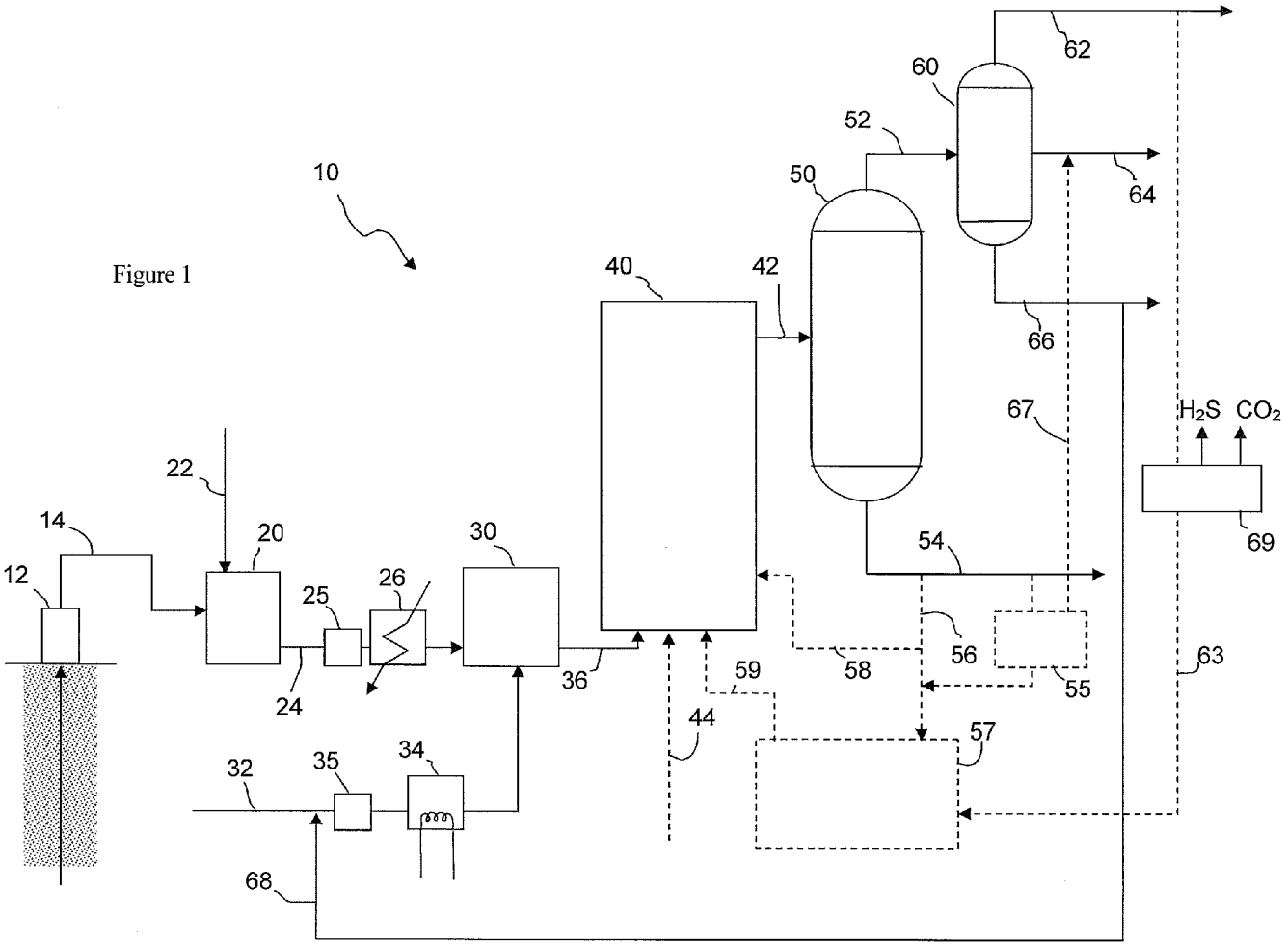
FIG. 1 describes one embodiment of the method.

Referring now to the Figure one, the system 10 constructed in accordance with the present invention includes a wellhead

12, storage tank 20, slurry mixer 30, reactor 40, hot separator 50, and three-phase separator 60. Wellhead 12 receives raw crude from a well and feeds it via line 14 into storage tank 20. In some situations, the raw crude may include an amount of water and may or may not be an emulsion. While the present system does not require removal of this water before the crude/heavy oil is processed, the water can be removed using any suitable technique if removal is desired.

Use of supercritical water means that hydrogenation is done through hydrogen from the water. It is theorized that use of the supercritical water eliminates the need for a hydrogen manufacturing plant (such as steam methane reformer) that would require additional machinery and cost.

The typical properties of the crude oil or heavy oil to be processed are:

| Property | Broad Range | Narrow Range |
|---|---|---|
| API | <15 | <10 |
| Viscosity at 60° F. | >100,000 cSt | >500,000 cSt |
| Sulfur Content | >6 wt % | >4 wt % |
| Nitrogen Content | >1000 ppm | >500 ppm |
| Metal | >500 ppm | >250 ppm |
| Total Acid Number | >3 | >2 |
| Asphaltenes | >10% | >5% |

The target properties of the pipeline transportable liquid synthetic crude to be obtained from this process are:

| Property | Broad Range | Narrow Range |
|---|---|---|
| API | >15 | >19 |
| Viscosity at 60° F. | <500 cSt | <350 cSt |
| Sulfur Content | <3 wt % | <2 wt % |
| Nitrogen Content | <100 ppm | <50 ppm |
| Metal | <100 ppm | <50 ppm |
| Total Acid Number | <1 | <0.5 |
| Asphaltenes | <5% | <2.5% |

In storage tank 20, the crude oil, heavy oil, bitumen, deasphalted oil or resid is mixed with a catalyst that enters tank 20 via line 22. Any suitable catalyst can be used, for example the catalyst may be any suitable combination of catalysts compromising a water gas shift catalyst, cracking catalyst and a hydrogenation catalyst, such as are known in the art, may be used. In one embodiment the catalyst is a group 4 or a group 8 metal catalyst such as ZrO2 or iron based catalysts. It is preferred that the catalyst be provided as a fine powder, such as 1-100 micron, or even below 10 micron, so that slurry conditions within the reactor can be maintained. Concentration of the catalyst can be 1-10 wt % of the feed or even 1-2% of the feed. It will be understood that mixing of the crude with the catalyst could be carried out in a separate tank from storage tank 20, if desired. The mixture of catalyst and crude oil leaves tank 20 via line 24, is pressurized by a pump 25 and heated in a preheater 26, and is injected into slurry mixer 30.

Supercritical water is also injected into mixer 30 via a feed line 32. The supercritical water can also contain the recycled water phase from 66 transported to the feed line via line 68. In doing so the amount of water needed in the method is decreased. Additionally, since the water coming from line 66 is already heated less energy would be required to heat the water back to a supercritical condition. Mixer 30 is preferably operated at supercritical conditions of >3000 psi and >350° C. Before entering mixer 30, the supercritical water is raised to a desired pressure and temperature by a pump 35 and heater 34. The amount of supercritical water used is dependent upon the oil. In one embodiment the water to oil ratio is between 3:1 to 1:1, preferably the water to oil ratio is 1.5:1. In yet another embodiment CO can be added to the supercritical water to provide increase oil yield.

Pump 35 may be any suitable pump and heater 34 may be a resistance heater, gas-fired boiler, or any other suitable heater type. In slurry mixer 30, the hot crude/catalyst mixture from line 24 is injected into the supercritical water. The resulting crude/catalyst/water slurry is immediately injected into a reaction zone at the bottom of reactor 40.

In reactor 40, heavy crude is thermally cracked at the reaction conditions and produces free radicals, which in turn extract hydrogen from the supercritical water to produce lighter hydrocarbons. Reactor 40 is preferably sized such that the reactants remain in reactor 40 for an average residence time of from about 5 to about 60 minutes, more preferably 10-20 min. If desired, part or all of the unconverted hydrocarbons from downstream in the process can be recycled into the reactor via line 58 and carbon monoxide and/or hydrogen from a downstream gasifier (described below) can also be injected into reactor 40 via line 59. If desired, additional hot (>300° C.) air may be introduced and injected into the reactor vessel through gas inlet 44. The purpose of this air is to produce hydrogen in situ via partial oxidation and shift reaction.

Figure 2:
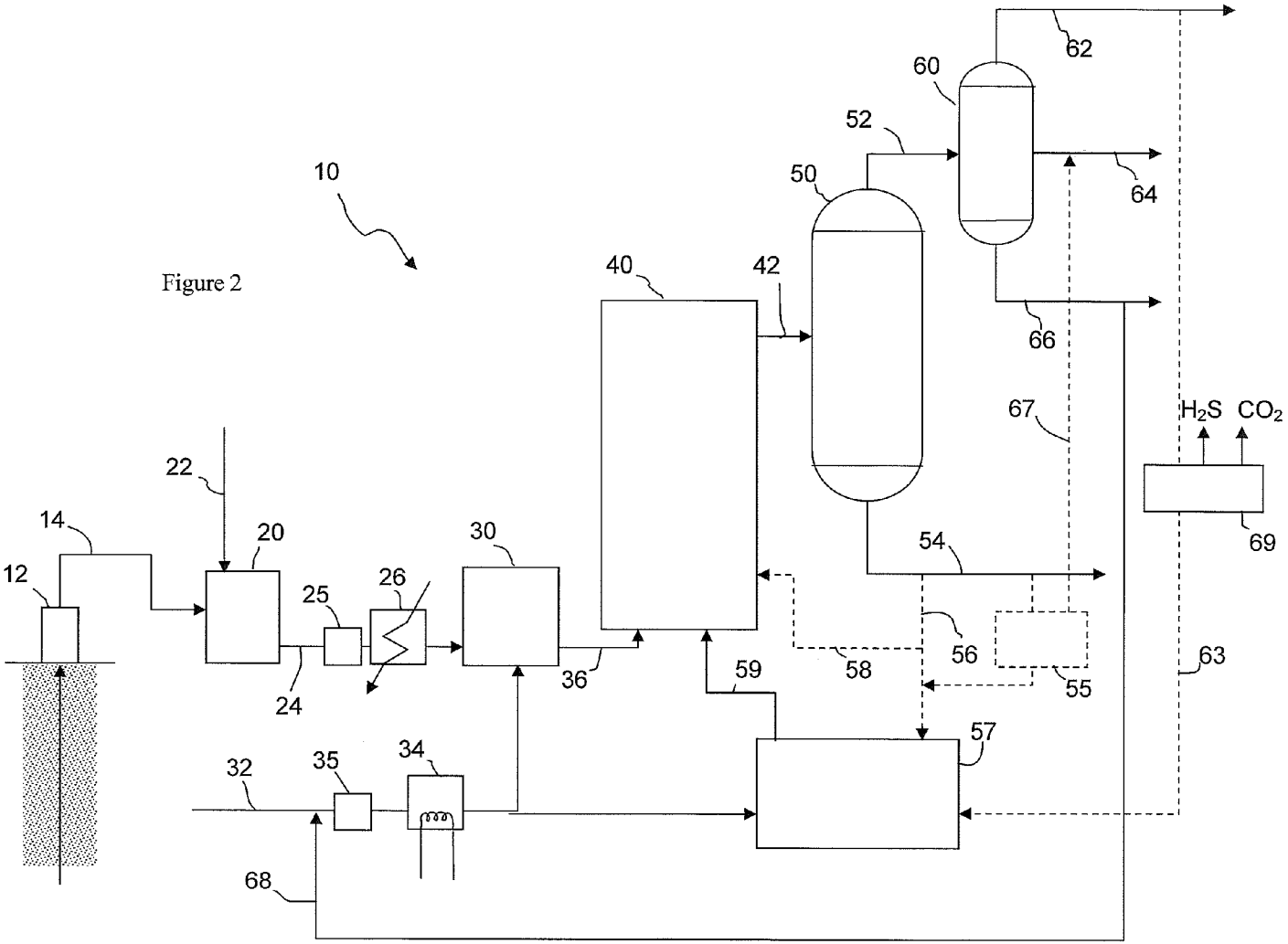
FIG. 2, describes an alternate embodiment of the method.

In one embodiment, as shown in FIG. 2, it is possible to direct some of the super critical water from the heater 34 directly into the gasifier 57. By doing so it eliminates the need have a gas inlet to inject hot air/oxygen into the system. The supercritical water can contain added CO. The elimination of this step is desirable as the separation of oxygen and nitrogen in a gasifier is an expensive and energy intensive process. Therefore, steam gasification would occur in the gasifier in the presence of a suitable catalyst and the following reaction would occur.

$$C+H_2O=CO+H_2$$

$$CO+H_2O=CO_2+H_2$$

The heavy crude/catalyst/water slurry may be injected into reactor 40 via one or more nozzles in the reactor vessel. The preheating step and the supercritical water phase preferably provide sufficient heat to the incoming feed to ensure that thermal decomposition occurs. After the desired residence time in the reactor, lighter hydrocarbon products exit from the top of the reactor via line 42. Because reactor 40 is an up-flow reactor, line 42 is preferably in fluid communication with the upper half, and more preferably the upper quarter, of reactor 40. In some embodiments, (not shown) unconverted heavy residue along with solids (catalysts, metals and coke formed) may be withdrawn from the bottom of the reactor.

There are five main reactions that are occurring in reactor 40.

(i) Thermal cracking of high molecular weight hydrocarbons→free radicals of low molecular weight hydrocarbons (ii) Free Radical Low Molecular Weight Hydrocarbons+$H_2$ from Supercritical water→Low Molecular Weight Hydrocarbon Molecules (iii) C+Supercritical $H_2O$→$CO+H_2$ (iv) Sulfur+CO from syngas→COS+lighter hydrocarbons (v) Sulfur in Hydrocarbons+$O_2$ from Supercritical water→$SO_2$+lighter hydrocarbons Reaction products, including gaseous and liquid hydrocarbons and supercritical water are removed from the top of reactor 40 via line 42 and enter hot separator 50. Hot separator 50 is preferably operated at sub-critical conditions at lower pressure and temperature such that water losses its supercritical properties and lighter liquid products including the gaseous hydrocarbons, other gaseous and water are removed from the top of separator 50 via line 52, while heavier hydrocarbons precipitates out including unconverted resid/pitch, which may contain metals, catalysts and/or coke, is removed from the bottom of hot separator 50 via line 54.

All or a portion of the unconverted resid/pitch heavy products from line 54 can be recycled directly to reactor 40 via line 58 in order to increase the yield of lighter products. Alternatively, if desired, some or all of the materials in line 54 can be passed through an optional vacuum flash unit 55 and separated into more volatile hydrocarbons and less volatile hydrocarbons. If desired, the more volatile hydrocarbons can be added to liquid hydrocarbon product in line 64 via line 67.

Alternatively, or in addition, a portion of the heavy products from line 54 can be subjected to gasification and/or catalytic oxidation and/or catalytic steam gasification, through line 56 in an optional gasifier 57 so as to produce syngas ($CO+H_2$). Gasifier 57 can be a plasma gasifier, or other suitable device. The resulting gas or syngas can be injected into reactor 40 via line 59 in order to increase hydrogenation therein.

If desired, additional hydrogen can be produced inside the reactor through shift reaction with the production of CO through partial oxidation by injecting air into the heavy crude/catalyst/water slurry via line 44 into reactor 40. If CO or syngas is added to reactor 40, it is preferred to use as the catalyst a compound comprising zirconium oxide (10-80%) and iron oxide. The iron oxide may be present as a catalyst support. Alternatively, the catalyst may be any suitable combination of catalysts compromising a water gas shift catalyst and a hydrogenation catalyst.

The products leaving the top of hot separator 50 via line 52 preferably enter three-phase separator 60, which further separates the stream into three fractions. In certain embodiments, the fractions may comprise a gaseous top product, which exits via line 62, a liquid hydrocarbon product, which exits via middle line 64, and a water phase, which exits via bottom line 66. The upgraded liquid product in line 64 is the most desirable salable product that is known as "synthetic crude oil" and can be pipelined to a refinery for further treatment to produce gasoline diesel jet fuel or transportation fuel. If desired, the water in line 66 may be cleaned and recycled to the supercritical system via line 68. A cleaning unit (not shown) such as are known in the art may be included in line 68. If desired, the gaseous top product phase in line 62, which usually consists of $C_1$-$C_4$ hydrocarbons, $CO_2$ and $H_2S$, may be cleaned in an acid gas treatment plant 69, and recycled to the gasifier 57 through line 63, in order to generate additional syngas for the reactor 40.

The properties of the liquid that flows through line 64 are dependent upon whether CO is added to the supercritical water. Typical properties of the desirable light hydrocarbon products that could be transported via pipeline include:

| Property | Supercritical water | Supercritical water with CO |
|---|---|---|
| Boiling Point of C5 + liquid | 80-1000° F. | 80-1000° F. |
| Minimum Yield Range | 65-70 wt % | 70-75 wt % |
| API | 28-35 | 30-36 |
| Viscosity at 60° F. | 100-200 cSt | 100-200 cSt |
| Sulfur | 1.5-2.5 wt % | 1.5-2.5 wt % |
| Metals | 50-100 | 50-100 |

-continued

| Property | Supercritical water | Supercritical water with CO |
|---|---|---|
| Total Acid Number | 0.5 | 0.4 |
| Asphaltenes | <5 | <5 |

The catalyst added to the crude preferably comprises a mixture of two or more inorganic metal compounds, such as zirconia and iron oxide. The catalyst is preferably provided as particles or as a fine powder (10-100 micron) and may comprise two or more metals selected from the group consisting of: $ZrO_2$, $Fe_2O_3$, $K_2O_3$, $NaCO_3$, other metal oxides such as Ni/Co, metal carbonates, and combinations thereof.

In operation, the slurry containing catalyst and heavy crude is heated to about 100 to 500° C. (200 to 930° F.) before being injected into the supercritical water. Likewise, the water is heated to supercritical conditions, preferably a temperature greater than 300° C., more preferably greater than 370° C. (700° F.), and a pressure greater than 22 MPa (3200 psi). Temperature and pressure within reactor 40 are preferably maintained between 400 and 500° C. (752 and 932° F.) and between about 20.7 and 34.5 MPa (3000 and 5000 psig). In hot separator 50 downstream of reactor 40, temperature and pressure are preferably maintained between 300 and 400° C. (572 and 752° F.) and between about 13.8 and 20.7 MPa (2000 and 3000 psig).

Example

The batch unit consists of a high-pressure 500 mL reactor, which is further connected to a high-pressure vessel (separator) to collect distillate product and water. Because of high pressure operation, the whole set-up was placed inside a high-pressure cell and operated from out side the cell. All other necessary safety requirements were met. The outlet of the separator was connected to a vent line through $H_2S$ scrubber. The reactor was usually charged with about 50 g of Athabasca Bitumen crude and about 50 g water. In a few cases water to crude ratio was varied from 0.5 to 1.5 by weight. In most of the cases a mixture of Zirconium oxide (ZrO2) (about 10% of crude) and promoter potassium carbonate (about 1% of ZrO2) was used as catalyst. The reactor was first pressure tested to 3500 psi with N2 then depressurized. Whenever required, about 100-120 psi (cold) CO or hydrogen was added to the system. For steam only cases the reactor was pressurized with $N_2$. At reaction conditions partial pressure of added gas was about 8 to 10% of the total pressure.

The reactor was heated to required temperature (in most cases 800° F.) and hold for certain time (most cases 30 min). The final pressure reached between 2800 to 3200 psi, except when water to crude ratio was 0.5, the pressure was below 2000 psi. Then the reactor was cooled to around 650° F. and pressure was released to the separator where distillate and steam were collected along with gaseous products. Separator was cooled and gas was released to vent line. In a few cases gas samples were collected for analysis. The distillate product was separated from the water easily in a separating funnel and weighed (W2). The reactor content was weighed (W3) and then filtered and washed with toluene under vacuum to remove the catalyst and coke formed. Difference between the weights of dry solid (W4) and catalyst reported here as coke yield. Difference between the weights of total reactor content and the dry weight of the solid (W5=W3−W4) gave the amount of resid in the reactor. Total liquid yield reported here as the sum of the amount of distillated recovered in the separator and the weight of the solid free residue (W2+W5).

| Run # | Water/ Crude Ratio | Added Gas Cold | Catalyst Type | Catalyst/ Oil Ratio | Pressure Average | Run Time Min | Temp ° F. | Mass Balance | Wt % Oil Yield | Wt % Coke Yield | Overhead API | Total Liquid API | Wt % Sulfur in Overhead | Wt % Sulfur in total Liquid |
|---|---|---|---|---|---|---|---|---|---|---|---|---|---|---|
| 1 | 1 | $H_2$ | $ZrO_2$ | 0.1 | 1711 | 30 | 800 | 79 | | | 33.3 | | 1.91 | |
| 2 | 1.2 | $H_2$ | $ZrO_2$ | 0.1 | 3279 | 60 | 790 | 86.07 | 59.3 | 19.7 | 32.2 | | 2.58 | |
| 3 | 1 | $H_2$ | $ZrO_2$ | 0.1 | 2678 | 60 | 800 | 78.5 | 64.9 | 20.9 | 36.9 | | 2.13 | |
| 4 | 1 | $H_2$ | $ZrO_2$ | 0.1 | 3261 | 30 | 820 | 87.17 | 58.8 | 21.1 | 32.7 | | 3 | |
| 5 | 1.5 | $H_2$ | $ZrO_2$ | 0.11 | 3324 | 30 | 796 | 97.6 | 66.9 | 18.5 | | 14.2 | | 2.91 |
| 6 | 1.5 | $H_2$ | $ZrO_2$ | 0.04 | 2596 | 30 | 840 | 86.6 | 59.7 | 21.4 | 28.5 | | 3.92 | |
| 7 | 1.4 | $N_2$ | $ZrO_2$ | 0.04 | 3246 | 30 | 840 | 90 | 61.5 | 24.8 | | 27.1 | | 4.08 |
| 8 | 1.3 | $N_2$ | $ZrO_2$ | 0.03 | 3251 | 60 | 807 | 92.6 | 65.1 | 23.8 | | 27 | | 3.76 |
| 9 | 1.7 | $N_2$ | $ZrO_2$ | 0.05 | 3003 | 60 | 840 | 82.8 | 51.3 | 29.6 | 24.2 | | | 3.97 |
| 10 | 0 | $N_2$ | $ZrO_2$ | 0.08 | 401 | 30 | 800 | 91.6 | 54.6 | 27.1 | | | | |
| 11 | 0 | $N_2$ | $ZrO_2$ | 0.06 | | 30 | 840 | 78.2 | 38.1 | 38.4 | | | | |
| 12 | 1 | $H_2$ | Zeolyst | 0.1 | 2753 | 30 | 800 | 86.9 | 76.5 | 12.1 | | 22.6 | | |
| 13 | 1 | $N_2$ | Zeolyst (ground) | 0.1 | 2848 | 30 | 800 | 91.8 | 74.1 | 13.9 | 31.8 | | 4.65 | |
| 14 | 1 | $N_2$ | $ZrO_2$ | 0.19 | 2672 | 30 | 800 | 92.4 | 67.3 | 22.6 | | 23.2 | | 3.2 |
| 15 | 1 | CO | $Fe_2O_3/Cu/SiO_2$ | 0.1 | 1915 | 30 | 800 | 90.1 | 76.4 | 14.8 | | 15.9 | | 2.58 |
| 16 | 1 | CO | Ni/Mn | 0.1 | 2233 | 40 | 800 | 82.8 | 75.5 | 8.8 | | 13.2 | | 2.85 |
| 17 | 1 | CO | Spent KF848 | 0.24 | 2997 | 30 | 840 | 92.5 | 69.9 | 22.8 | | 19.9 | | 2.29 |
| 18 | 1 | $H_2$ | Spent KF849 | 0.18 | 3178 | 30 | 840 | 92.7 | 63.9 | 25.1 | | 19.1 | | 2.21 |
| 19 | 1 | CO | $ZrO_2$ | 0.19 | 3027 | 30 | 800 | 94.7 | 71.6 | 19.9 | | 21.8 | | 2.31 |
| 20 | 0.5 | CO | $ZrO_2$ | 0.1 | 1808 | 30 | 800 | 95.7 | 89.7 | 7.5 | | 17.7 | | 2.35 |
| 21 | 0.4 | CO | $Fe_2O_3/Cu/SiO_2$ | 0.07 | 1710 | 30 | 800 | 89.2 | 80.7 | 11.1 | | 12.5 | | 3.31 |
| 22 | 0.5 | CO | $ZrO_2$ | 0.1 | 1915 | 30 | 800 | 93.6 | 92.4 | 5.8 | | 14.8 | | 2.21 |
| 23 | 0.5 | CO | $ZrO_2$ | 0.1 | 2093 | 30 | 843 | 85.5 | 62.4 | 26.4 | | 27.1 | | 2.72 |
| 24 | 0.5 | CO | $ZrO_2$ | 0.1 | 1873 | 60 | 805 | 95.6 | 86.1 | 9.1 | | 17.4 | | 3.14 |
| 25 | 1 | $N_2$ | Spent KF849 | 0.14 | 2403 | 5 | 810 | 93.1 | 96.1 | 2.6 | | 16.1 | | 2.63 |

Influence of SCW and added gases on products yields.
Run conditions: 800 F./30 min/2800-3000 psig.
Partial pressure of added gases is about 10% of total pressure.
scw = supercritical water

| Operating conditions | | | Total liquid yield, | Properties of total C5+ liquid product stream | | | |
|---|---|---|---|---|---|---|---|
| Run # | Added Gas | Catalyst | wt % of feed | C5-650° F. light oil, Wt % of feed | 650-1000° F. Gas oil, wt % of feed | 1000° F.+ resid, wt % of feed | Coke yield, wt % of feed |
| Feed | | | | 12.2 | 34.0 | 53.8 | |
| 16 | No SCW | $ZrO_2$ | 54.6 | 37.2 | 10.8 | 12.0 | 27.1 |
| 27 | SCW + $N_2$ | $ZrO_2$ | 67.3 | 44.1 | 16.2 | 7.7 | 22.6 |
| 10 | SCW + $H_2$ | $ZrO_2$ | 66.9 | 36.7 | 19.1 | 11.1 | 18.5 |
| 32 | SCW + CO | $ZrO_2$ | 71.6 | 31.2 | 29.1 | 11.3 | 19.9 |
| 25 | SCW + $H_2$ | Zeolyst | 76.5 | 47.4 | 22.6 | 7.3 | 12.1 |
| 28 | SCW + CO | $Fe_2O_3$ | 76.4 | 39.3 | 23.7 | 13.4 | 14.8 |

Influence of SCW and added gases on products yields.
Run conditions: 840 F/30 min/2800-3000 psig.
Partial pressure of added gases is about 10% of total pressure.
scw = supercritical water

| Operating conditions | | | | |
|---|---|---|---|---|
| Run # Feed | Added Gas | Catalyst | Total liquid yield, wt % of feed | Coke yield, wt % of feed |
| 17 | No SCW | $ZrO_2$ | 54.6 | 38.4 |
| 12 | SCW + $N_2$ | $ZrO_2$ | 67.3 | 24.8 |
| 11 | SCW + $H_2$ | $ZrO_2$ | 66.9 | 21.4 |
| 37 | SCW + CO | $ZrO_2$ | 71.6 | 26.2 |
| 31 | SCW + $H_2$ | KF848 | 76.5 | 25.1 |
| 30 | SCW + CO | KF848 | 76.4 | 22.8 |

Effect of temperature on oil yields
Run conditions: 30 min/3000-3200 psig/$ZrO_2$ catalyst
scw = supercritical water

| | Temp ° F. | |
|---|---|---|
| | 800° F. | 840° F. |
| SCW + $N_2$ | 67.3 wt % | 61.5 wt % |
| SCW + $H_2$ | 66.9 wt % | 59.7 wt % |
| Average | 67.1 wt % | 60.6 wt % |

Effect of temperature on coke yields
Run conditions: 30 min/3000-3200 psig/$ZrO_2$ catalyst
scw = supercritical water

| | Temp ° F. | |
|---|---|---|
| | 800° F. | 840° F. |
| SCW + $N_2$ | 22.6 wt % | 24.8 wt % |
| SCW + $H_2$ | 18.5 wt % | 21.4 wt % |
| Average | 20.6 wt % | 23.1 wt % |

Effect of time on oil yields
Run conditions: SCW + N2/3000-3200 psig/$ZrO_2$ catalyst
scw = supercritical water

| | Time/min | |
|---|---|---|
| | 30 | 60 |
| 800° F. | 67.3 wt % | 65.1 wt % |
| 840° F. | 61.5 wt % | 51.3 wt % |

Effect of time on coke yields
Run conditions: SCW + N2/3000-3200 psig/$ZrO_2$ catalyst
scw = supercritical water

| | Time/min | |
|---|---|---|
| | 30 | 60 |
| 800° F. | 22.6 wt % | 23.8 wt % |
| 840° F. | 24.8 wt % | 29.6 wt % |

Effect of CO pressure and/or water-to-oil ratio on oil yields
Run conditions: CO + SCW/800 F/30 min
(CO partial pressure about 10% of total)

| | Approx Pressure (Psig) | |
|---|---|---|
| | Low 1800-2000 | High 2800-3200 |
| Water/oil ratio | 0.5 | 1.0 |
| $ZrO_2$ | 93.7, 89.7<br>Average 91.7 | 71.6 |
| $Fe_2O_3$ | 81.7 | 76.4 |
| Ni—Mn | | 75.5 |
| Average | 88.2 | 74.5 |

Effect of CO pressure and/or water-to-oil ratio on coke yields

| Approx Pressure (Psig) | Low 1800-2000 | High 2800-3200 |
|---|---|---|
| Water/oil ratio | 0.5 | 1.0 |
| $ZrO_2$ | 5.8, 7.5 Average 6.7 | 19.9 |
| $Fe_2O_3$ | 11.1 | 14.8 |
| Ni—Mn | | 8.8 |
| Average | 8.9 | 14.4 |

Run conditions: CO + SCW/800 F./30 min (CO partial pressure about 10% of total)

Desulfurization in the presence of added gases to SCW
Run conditions: All runs reported here are at 30 min
(Partial pressure of added gas is about 10% of total)
Feed sulfur = 3.9 wt %

| Conditions | Catalyst | SCW + $N_2$ | SCW + $H_2$ | SCW + CO |
|---|---|---|---|---|
| 800° F./2800 psig | $ZrO_2$ | 3.2 | 2.91 | 2.31 |
| 800° F./1800 psig | $ZrO_2$ | | | 2.51 |
| 800° F./2800 psig | Fe/K | | | 2.58 |
| 800° F./2800 psig | Ni/Mn | | | 2.29 |
| 840° F./3200 psig | KH848 | | 2.29 | 2.21 |

Deacidification in the presence of added gases to SCW
Run conditions: 800° F./30 min/$ZrO_2$ catalyst/2800 psig
(Partial pressure of added gas is about 10% of total)

| Conditions | Feed | SCW + $N_2$ | SCW + $H_2$ | SCW + CO |
|---|---|---|---|---|
| Total Acid Number | 4.3 | 0.38 | 0.5 | 0.45 |
| wt % acid removal | | 91.1% | 88.3% | 89.5% |

Demetallization with SCW and hydrogen
Run conditions: 800° F./30 min/$ZrO_2$ catalyst/2800 psig
(Partial pressure of added gas is about 10% of total)

| Metals | Metal in Feed | Metal in product oil | wt % metal removal |
|---|---|---|---|
| V | 430 | 67 | 84.5% |
| Ni | 98 | 23 | 76.5% |

Comparison of hydrogenation effect of added gases H2/CO
Run conditions: 840 F/30 min/2800-3200 psig/KF848 catalyst
(Added gas partial pressure about 10% of total)

| Properties, wt % | Feed | Liquid product with $H_2$ + SCW | Liquid product with CO + SCW |
|---|---|---|---|
| Saturates | 16.1 | 21.6 | 23.7 |
| 2-ring aromatics | 0 | 3.6 | 4.4 |
| 3-6 ring aromatics | 5.4 | 6.5 | 8.8 |

While preferred embodiments of this invention have been shown and described, modifications thereof can be made by one skilled in the art without departing from the spirit or teaching of this invention. For example, while storage tank 20 and slurry mixer 30 are disclosed as two separate components, it will be understood that they could be combined into a single device. Likewise, feed lines and outflow lines could be repositioned or reconfigured in a manner other than that shown in the Figure. Accordingly, the scope of protection is not limited to the embodiments described herein, but is only limited by the claims which follow, the scope of which shall include all equivalents of the subject matter of the claims.

What is claimed is:

1. A method comprising:

a) mixing a catalyst with a heavy oil to create a heavy oil/catalyst mixture; and b) combining the heavy oil/catalyst mixture with supercritical water to form light hydrocarbon products and heavy hydrocarbon products;

wherein the light hydrocarbon products can be separated into a gaseous top product, an upgraded liquid hydrocarbon product and a water phase;

wherein the catalyst is zirconium oxide that is promoted with an alkali salt that is present in an amount of about 1% of the zirconium oxide.

2. The method of claim 1, wherein the heavy oil has an API less than 10.

3. The method of claim 1, wherein the upgraded liquid hydrocarbon product has an API greater than 19.

4. The method of claim 1, wherein the heavy oil has a viscosity greater than half million cSt at 60° F.

5. The method of claim 1, wherein the upgraded liquid hydrocarbon product has a viscosity lower than 350 cSt at 60° F.

6. The method of claim 1, wherein the upgraded liquid hydrocarbon has a nitrogen content less than 100 ppm.

7. The method of claim 1, wherein the gaseous top product contains C1-C4, $H_2S$, CO, $CO_2$ and $H_2$.

8. The method of claim 1, wherein a portion of the supercritical water comprises from recycling the water phase.

9. The method of claim 1, wherein the supercritical water contains added CO.

* * * * *